US005803157A

United States Patent [19]

Brophy et al.

[11] Patent Number: 5,803,157

[45] Date of Patent: Sep. 8, 1998

[54] SEMI-MODULAR PINRACK SEAL

[75] Inventors: Mark E. Brophy; Thomas G. Geyer, both of Wellsville; Rex R. Snider, Corfu, all of N.Y.

[73] Assignee: ABB Air Preheater, Inc., Wellsville, N.Y.

[21] Appl. No.: 705,998

[22] Filed: Aug. 30, 1996

[51] Int. Cl.[6] ..... F23L 15/02

[52] U.S. Cl. ..... 165/9; 165/10; 165/8

[58] Field of Search ..... 165/9, 8, 10, 6; 29/890.034

[56] References Cited

U.S. PATENT DOCUMENTS

| | | | |
|---|---|---|---|
| 2,670,934 | 3/1954 | Hammond et al. | 165/9 |
| 3,800,860 | 4/1974 | Johnsson | 165/9 |
| 4,073,337 | 2/1978 | Stockman | 165/9 |
| 4,316,499 | 2/1982 | Schlageter | 165/9 |
| 5,137,078 | 8/1992 | Borowy | 165/9 |
| 5,145,011 | 9/1992 | Seike et al. | 165/9 |
| 5,363,903 | 11/1994 | Hagar | 165/9 |

FOREIGN PATENT DOCUMENTS

| | | | |
|---|---|---|---|
| 0597222 | 5/1960 | Canada | 165/8 |
| 1290540 | 9/1972 | United Kingdom | 165/9 |

*Primary Examiner*—John Rivell
*Assistant Examiner*—Christopher Atkinson
*Attorney, Agent, or Firm*—Alix, Yale & Ristas, LLP

[57] ABSTRACT

A rotary regenerative air preheater has pinrack seals including a U-seal located between the upper and lower pinrack rails and a trough-shaped filler-seal located between the upper and lower pinrack supports of adjacent pinrack assemblies. The inboard edges of the wing portions of the filler seal are welded to the rotor shell, the outboard edge of each leg portion of the U-seal engages a pin in one of the adjacent pinrack assemblies, and the upper and lower edges of the U-seal and the filler-seal engage the upper and lower pinrack rails and the upper and lower pinrack supports, respectively, to seal the pinrack assemblies to the rotor shell.

16 Claims, 5 Drawing Sheets

SEMI-MODULAR PINRACK SEAL

BACKGROUND OF THE INVENTION

The present invention relates generally to rotary heat exchangers and, more specifically, to bypass seals for sealing the gap between the pinrack assembly and the rotor.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality of sector-shaped compartments by a plurality of radial partitions, known as diaphragms, extending from the rotor post to the outer peripheral shell of the rotor. These sector shaped compartments are loaded with modular heat exchange baskets which contain the mass of heat absorbent material commonly comprised of stacked plate-like elements.

A pinrack assembly is mounted to the outboard of the rotor. A drive mechanism engages the pins mounted in the pinrack assembly to rotate the rotor. Generally, such assemblies comprise upper and lower pinrack supports which are mounted to the rotor shell, upper and lower pinrack rails which are mounted to the lower surface of the upper pinrack support and to the upper surface of the lower pinrack support, and pins vertically mounted between the upper and lower pinrack supports. In conventional air preheaters, the upper and lower pinrack supports and the upper and lower pinrack rails comprise a plurality of discrete elements wherein several elements are required to span each rotor sector. In order to improve the efficiency of operation, it is conventional to provide seals, which are referred to as pinrack seal assemblies, to minimize the flow of gases between the pinrack assembly and the rotor shell.

Due to the presence of multiple support elements, U-seals must be mounted to close the gap between the upper and lower pinrack rails at each pin. A first filler seal is mounted between the pinrack supports and the pinrack rails to seal the gap therebetween. A second filler-seal is mounted between a U-seal on either side of the diaphragm which separates two sectors and the rotor shell to seal the gap between the U-seal and the rotor shell. Consequently, such seals require a minimum of seven (7) pieces and eight (8) welds. The components of conventional pinrack seals must be individually positioned to ensure that the gaps are properly closed. Therefore, such seals are assembled in place. Seals of this type are time-consuming to manufacture and install due to the large number of pieces, the large number of welds, and the in-place assembly.

SUMMARY OF THE INVENTION

The present invention relates to novel means for providing bypass seals for a rotary regenerative air preheater having upper and lower pinrack supports which are continuous from diaphragm to diaphragm of a rotor to prevent the bypass of gas streams through the gaps between the pinrack and the rotor. More specifically, a single U-seal seals the gap between the upper and lower pinracks and a single filler-seal is mounted to the rotor shell and the U-seal such that it extends between adjacent sectors to seal the gap between the U-seal and the rotor shell and the gap between adjacent sector compartments.

DESCRIPTION OF THE PREFERRED EMBODIMENT

Figure 1:
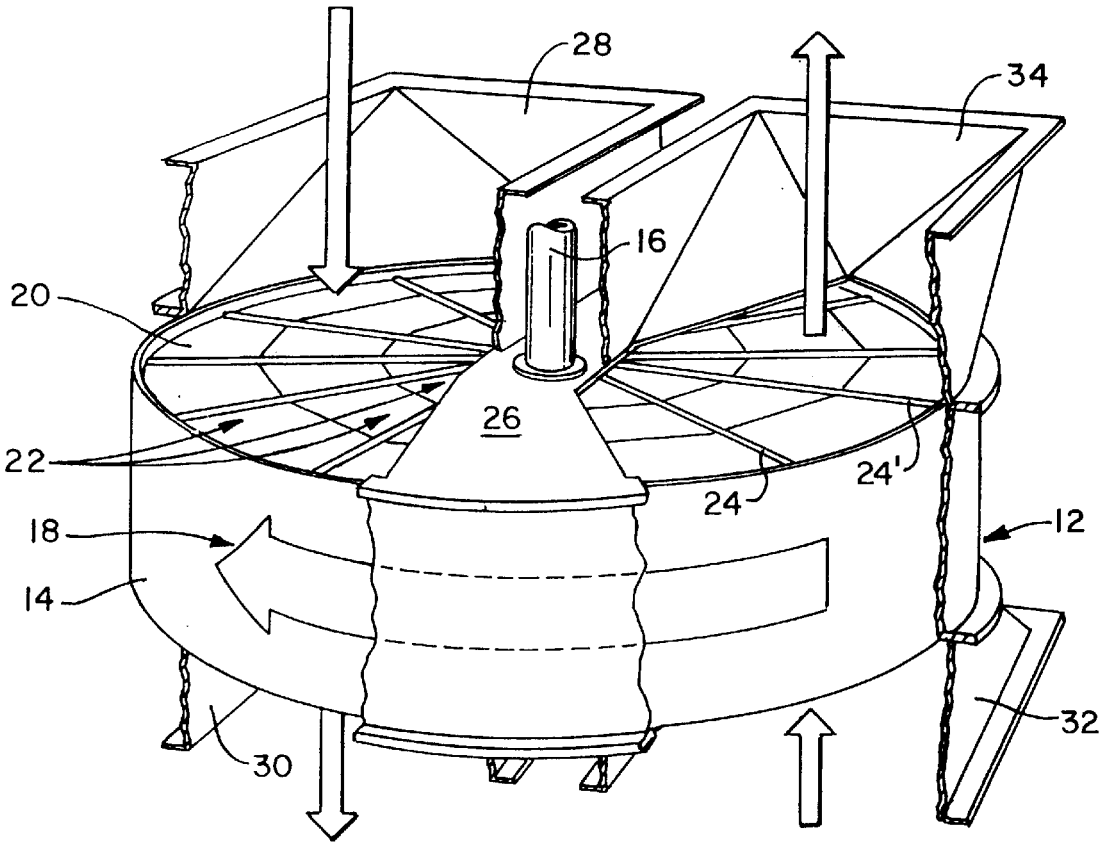
FIG. 1 PRIOR ART
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 24. The basket modules 22 contain the heat exchange surface. The housing 12 is divided by means of the flow impervious sector plate 26 into a flue gas side and an air side. A corresponding sector plate is also located on the bottom of the unit. The hot flue gases enter the air heater through the gas inlet duct 28, flow through the rotor where heat is transferred to the rotor and then exit through gas outlet duct 30. The countercurrent flowing air enters through air inlet duct 32, flows through the rotor where it picks up heat and then exits through air outlet duct 34.

Figure 2:
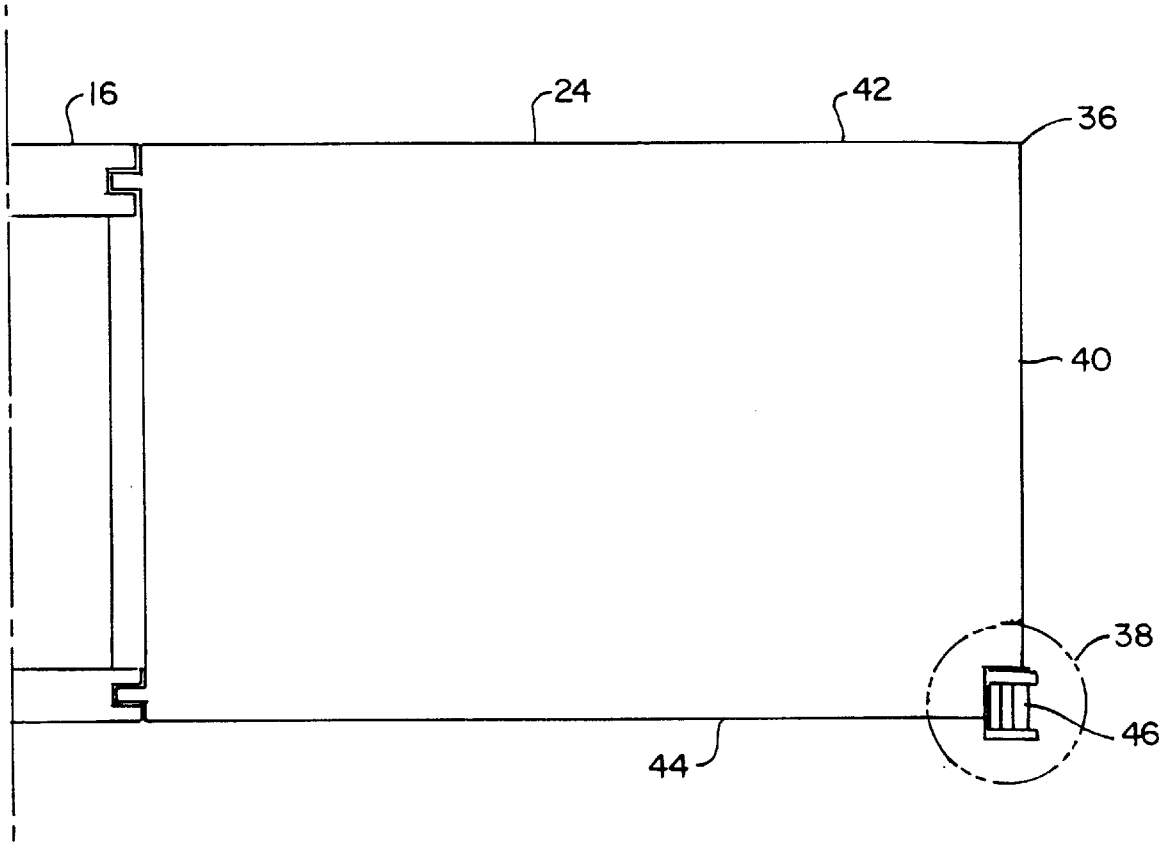
FIG. 2 PRIOR ART
FIG. 2 is a cross section view of a portion of the rotor of the preheater of FIG. 1 illustrating a portion of the rotor post, a diaphragm, the pinrack assembly and the pinrack seal assembly.

Referring now to FIG. 2 which shows a cross section view of a portion of the rotor 14, the diaphragms 24 are shown extending radially between the rotor post 16 and the rotor shell 36. In conventional rotary air preheaters, a pinrack assembly 38 is mounted to the outboard 40 of the rotor between the hot end 42 and the cold end 44. The drive mechanism (not shown) engages pins 46 mounted in the pinrack assembly 38 to rotate the rotor. An air preheater with semi-modular rotor construction is disclosed in co-pending U.S. patent application Ser. No. 08/604,914 filed on Feb. 22, 1996 now U.S. Pat. No. 5,615,732, which application is assigned to the assignee of the present invention and the disclosure of which is incorporated by reference. In such semi-modular rotor air preheaters, the pinrack assembly 38' is mounted to the lower outboard corner of the rotor, as shown in FIG. 2.

Figure 3:
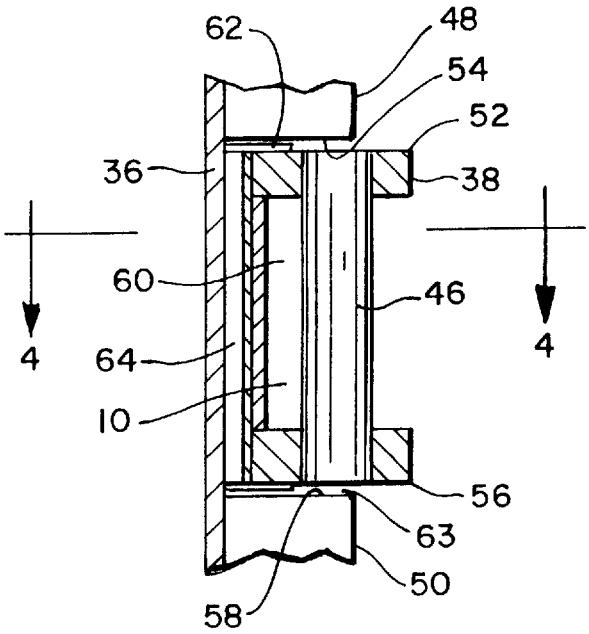
FIG. 3 PRIOR ART
FIG. 3 is an enlarged cross section view of the pinrack assembly area of FIG. 2, illustrating a prior art pinrack assembly and pinrack seal assembly.
Figure 5:
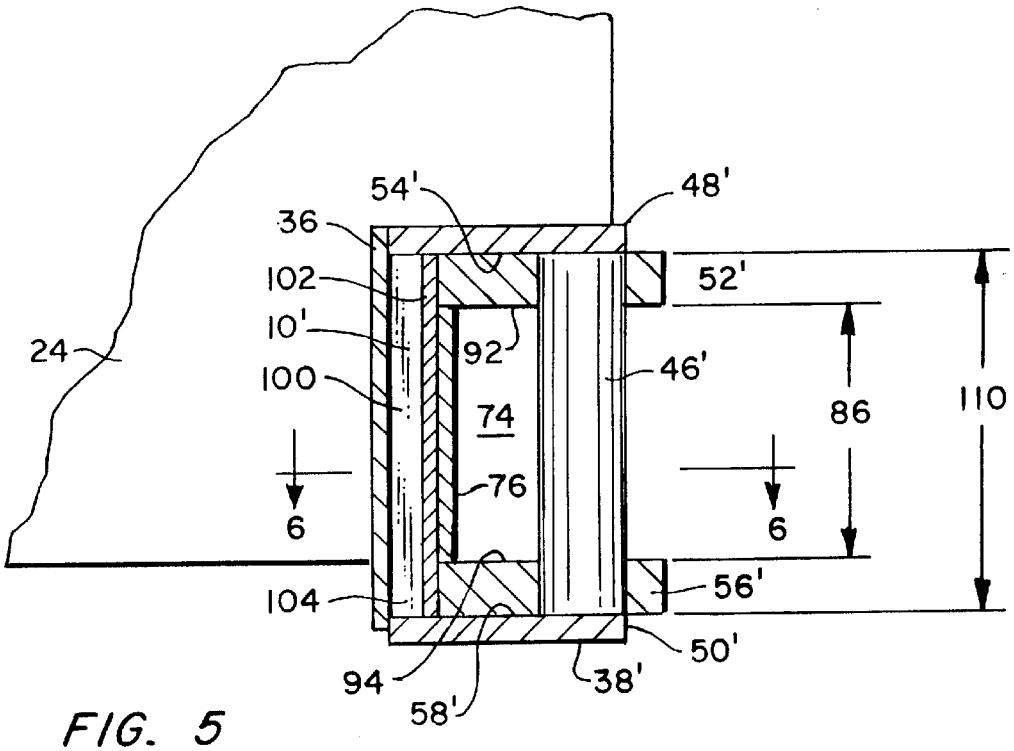
FIG. 5 is a view similar to a portion of FIG. 3 illustrating a semi-modular pinrack assembly and a pinrack seal assembly of the present invention.

With reference to FIGS. 3 and 5, the pinrack assembly generally comprises upper and lower pinrack supports 48, 48', 50, 50' which are mounted to the rotor shell 36. In a conventional air preheater rotor, the upper and lower pinrack supports 48, 50 comprise a plurality of discrete support elements wherein several support elements are required to span each rotor sector. Semi-modular air preheaters utilize the upper and lower pinrack supports 48', 50' as a proximity seal. Therefore, the upper and lower pinrack supports 48', 50' each comprise a single member which is continuous from one diaphragm 24 to the other diaphragm 24' (FIG. 1) of the rotor sector. Typically in a semi-modular air preheater, such upper and lower pinrack supports 48', 50' each comprise a plurality of support segments which are positioned in place and welded together to form a single member.

Figure 6:
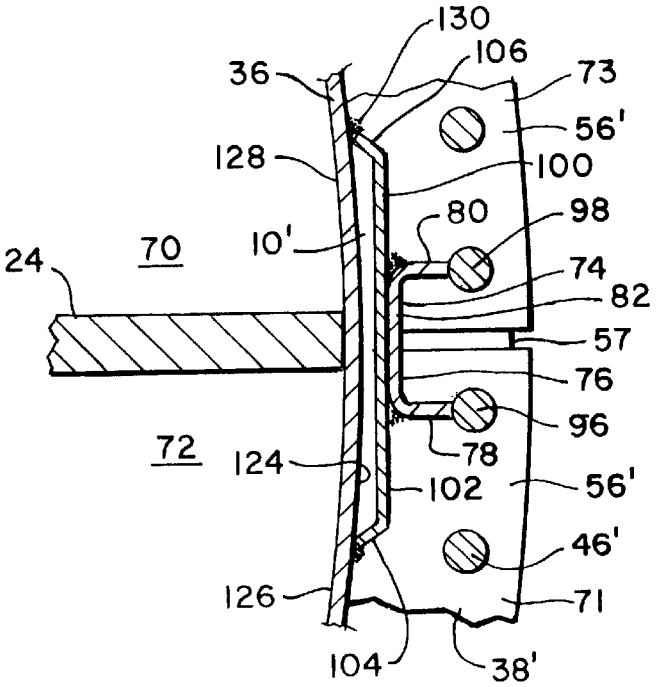
FIG. 6 is a cross section view of the semi-modular pinrack assembly and the pinrack seal assembly of the present invention, taken generally along line 6—6 of FIG. 5.
Figure 7:
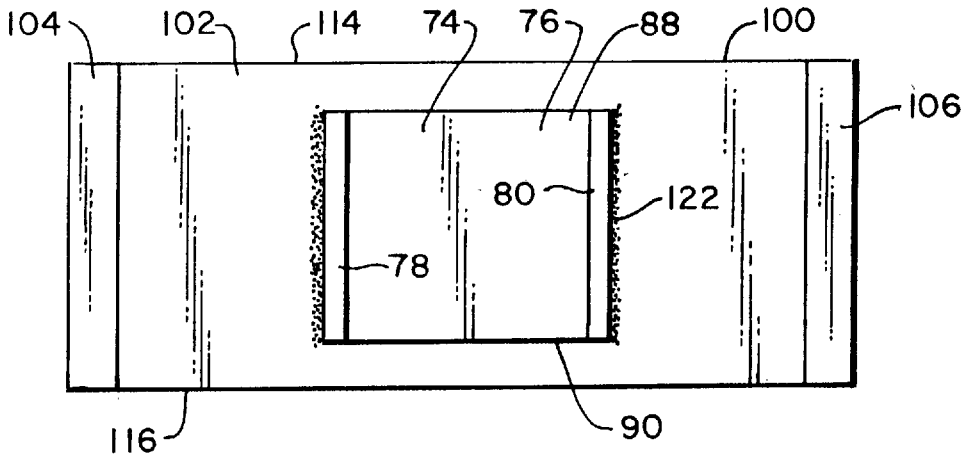
FIG. 7 is a front view of the pinrack seal assembly of FIG. 5.
Figure 8:
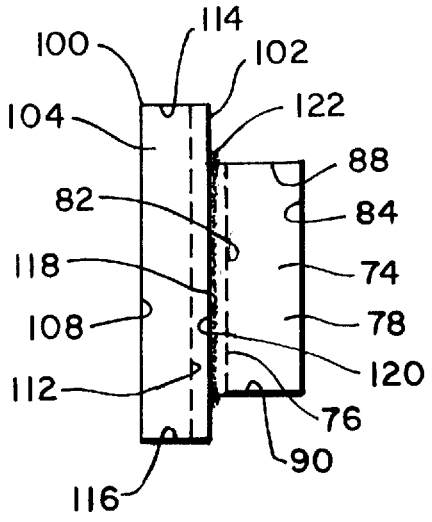
FIG. 8 is a side view, partly in phantom, of the pinrack seal assembly of FIG. 5.

An upper pinrack rail 52, 52' is mounted to the lower surface 54, 54' of the upper pinrack support 48, 48' and a lower pinrack rail 56, 56' is mounted to the upper surface 58, 58' of the lower pinrack support 50, 50'. A plurality of pins 46, 46' are vertically mounted in the pinrack assembly wherein the upper end of each pin 46, 46' is mounted in an opening in the upper pinrack rail 52, 52' and the lower end is mounted in an opening in the lower pinrack rail 56, 56'. Typically in a semi-modular air preheater, such upper and lower pinrack rails 52', 56' each comprise a plurality of pinrack rail segments which are separated by a gap 57. The gap 57 may occur adjacent a diaphragm 24, as shown in FIG. 6. However, such gaps 57 generally occur adjacent a single sector compartment.

Figure 4:
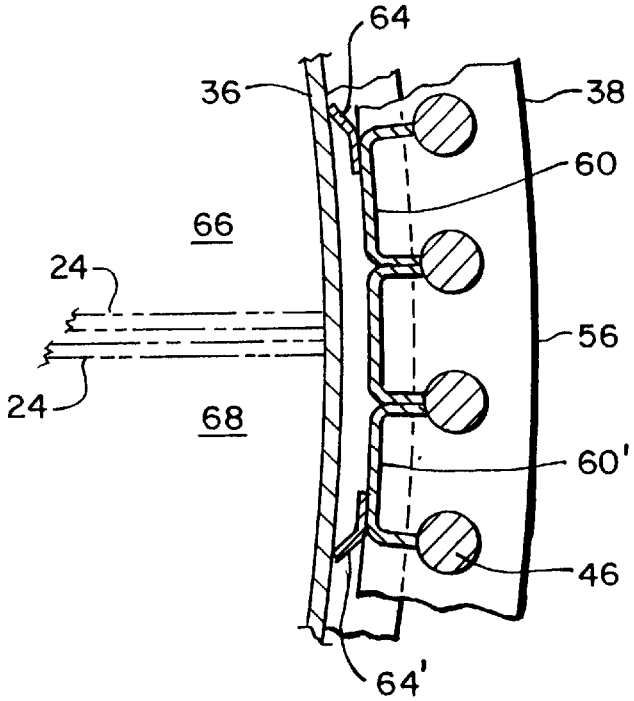
FIG. 4 PRIOR ART
FIG. 4 is a cross section view of the prior art pinrack assembly and pinrack seal assembly, taken generally along line 4—4 of FIG. 3.

In order to improve the efficiency of operation, it is conventional to provide seals, which are referred to as pinrack seal assemblies 10, 10', to minimize the flow of gases in the space between the pinrack assembly 38, 38' and the rotor shell 36. Due to the presence of multiple support elements, the prior art pinrack seal assembly 10 shown in FIGS. 3 and 4 utilizes a plurality of U-seals 60 which are mounted to close the gap between the upper and lower pinrack rail 52, 56 at each pin 46. A first filler seal 62 is mounted between the pinrack rails 52, 56 and the pinrack notch 63 in the diaphragm to seal the gap therebetween. A filler-seal 64, 64' is mounted between a U-seal 60, 60' on either side of the diaphragm 24 which separates two sectors 66, 68 and the rotor shell 36 to seal the gap between the U-seal 60, 60' and the rotor shell 36. Consequently, such seal assemblies 10 require a minimum of seven (7) pieces and eight (8) welds. Seal assemblies 10 of this type are time-consuming to manufacture and install.

FIGS. 5 through 8 illustrate the pinrack seal assembly 10' of the present invention. Since the upper and lower pinrack supports 48', 50' are continuous across the outboard chord of each rotor sector 70, 72, only a single U-seal 74 is required to seal the gap between the upper and lower pinrack rails 52', 56'. Each U-seal 74 comprises a base 76 and two legs 78, 80 which extend orthogonally from a first surface 82 of the base 76 to an outboard edge 84. As shown in FIG. 5 the height 86 of the U-seal 74 is selected such that the U-seal 74 may be inserted between the upper and lower pinrack rails 52', 56'. Preferably, the top and bottom edges 88, 90 of the U-seal 74 slidably engage the lower surface 92 of the upper pinrack rail 52' and the upper surface 94 of the lower pinrack rail 56'.

The U-seal 74 is inserted between the upper and lower pinrack rails 52', 56' such that the outboard edge 84 of the first and second legs 78, 80 contact the inboard side of the two pins 96, 98 closest to the diaphragm 24, whereby the U-seal 74 seals the gap between the upper and lower pinrack rails 52', 56'. As shown in FIG. 6, one of the pins 96 may be adjacent one sector compartment 72 and the other pin 98 may be adjacent the other sector compartment 73. However, the two pins may both be adjacent the same sector compartment.

A single trough-shaped filler-seal 100 is used to seal the gap between the U-seal 74 and the rotor shell 36 and to seal the gap between adjacent sector compartments 70, 72. Each filler-seal 100 comprises a base 102 and two wings 104, 106 which extend obliquely from a first surface 112 of the base 102 to an inboard edge 108. The height 110 of the filler-seal 100 is selected such that the filler-seal 100 may be inserted between the upper and lower pinrack supports 48', 50'. Since the upper and lower pinrack rails 52', 56' are mounted intermediate the upper and lower pinrack supports 48', 50', the height 110 of the filler-seal 100 is greater than the height 86 of the U-seal 74. Preferably, the top and bottom edges 114, 116 of the filler-seal 100 engage the lower surface 54' of the upper pinrack support 48' and the upper surface 58' of the lower pinrack support 50'.

The filler-seal 100 is mounted to the U-seal 74 wherein the outboard surface 118 of the base 102 of the filler seal 100 engages the inboard surface 120 of the base 76 of the U-seal 74. Two fillet welds 122 are used to mount the base 102 of the filler seal 100 to the base 76 of the U-seal 74 and to seal any gap that may exist between the filler seal 100 and the U-seal 74. The inboard edge 108 of the first wing 104 contacts the outboard surface 124 of the portion 126 of the rotor shell 36 associated with the one rotor sector 72 and the inboard edge 108 of the second wing 106 contacts the outboard surface 124 of the portion 128 of the rotor shell 36 associated with the adjacent rotor sector 70 whereby the filler-seal 100 seals the gap between the upper and lower pinrack supports 48', 50' and spans the remainder of the gap between adjacent sector compartments 70, 72. Seal welds 122, 130 are used to mount the base 102 of the filler-seal 100 to the base 76 of the U-seal 74 and to mount the wings 104, 106 of the filler-seal 100 to the rotor shell 36.

With the present invention, a positive seal is formed in the gaps between the pinrack assembly and the rotor shell and between adjacent sector compartments. At least two U-seals and the overlap plates are eliminated. Consequently, the number of welds that are required to assemble the pinrack seal are reduced. The pinrack seal of the present invention is less costly to manufacture and install.

We claim:

1. A pinrack seal assembly for a rotary heat exchanger having a rotor shell, a plurality of diaphragms defining a plurality of sector compartments wherein each diaphragm separates a first sector compartment from an adjacent second sector compartment, and a pinrack assembly including upper and lower pinrack supports, upper and lower pinrack rails mounted intermediate the upper and lower pinrack supports, and a plurality of pins mounted intermediate the upper and lower pinrack rails, wherein the upper and lower pinrack supports include a plurality of support segments, the support segments being substantially continuous from the first diaphragm to the second diaphragm, and wherein a first pin and a second pin are the two pins that are closest to the diaphragm separating the first sector compartment from the second sector compartment, the pinrack seal assembly comprising:

a unitary first seal comprising a base portion having oppositely disposed first and second surfaces and first and second leg portions extending substantially orthogonally from the first surface of the base portion; and a unitary second seal comprising a base portion having oppositely disposed first and second surfaces and first and second wing portions extending obliquely from the first surface of the base portion, wherein the second surface of the base portion of the second seal is mounted to the second surface of the base portion of the first seal;

wherein the first seal is positionable intermediate the upper and lower pinrack rails of the pinrack assembly such that the first leg portion is adjacent the first pin and the second leg portion is adjacent the second pin, and wherein the second seal is positionable intermediate the upper and lower pinrack supports of the pinrack assembly and the first wing portion of the second seal is mountable to the rotor shell proximate the first sector compartment and the second wing portion of the second seal is mountable to the rotor shell proximate the second sector compartment.

2. The pinrack seal assembly of claim 1 wherein each wing portion of the second seal is mountable to the rotor shell.

3. The pinrack seal assembly of claim 1 wherein the first seal further comprises first and second edges defining a height and the second seal further comprises first and second edges defining a height, wherein the height of the second seal is greater than the height of the first seal.

4. The pinrack seal assembly of claim 3 wherein the first edge of the first seal is engageable with the upper pinrack rail of the pinrack assembly and the second edge of the first seal is engageable with the lower pinrack rail of the pinrack assembly.

5. The pinrack seal assembly of claim 3 wherein the first edge of the second seal is engageable with the upper pinrack support of the pinrack assembly and the second edge of the second seal is engageable with the lower pinrack support of the pinrack assembly.

6. The pinrack seal assembly of claim 1 wherein the first and second legs of the first seal each comprise an outboard edge, wherein the outboard edge of the first leg is enagageable with the first pin and the outboard edge of the second leg is engageable with the second pin.

7. A rotary heat exchanger comprising:

a rotor shell;

a plurality of diaphragms disposed interiorly of the rotor shell, the diaphragms defining a plurality of diaphragm pairs and plurality of sector compartments, wherein one of the diaphragms separates a first sector compartment from an adjacent second sector compartment;

a pinrack assembly disposed exteriorly of the rotor shell comprising upper and lower pinrack supports mounted to the rotor shell, upper and lower pinrack rails mounted intermediate the upper and lower pinrack supports, and a plurality of pins mounted intermediate the upper and lower pinrack rails, wherein the upper and lower pinrack supports each comprise a plurality of support segments wherein the support segments are substantially continuous from one diaphragm of a diaphragm pair to the other diaphragm of the diaphragm pair and wherein a first pin and a second pin are the two pins that are closest to the diaphragm separating the first sector compartment from the second sector compartment; and a plurality of pinrack seal assemblies wherein each pinrack seal assembly comprises a U-shaped unitary first seal comprising a base portion and first and second leg portions and a trough-shaped unitary second seal comprising a base portion mounted to the base portion of the first seal and first and second wing portions, wherein the first seal is positioned intermediate the upper and lower pinrack rail of the pinrack assembly wherein the first leg portion is adjacent the first pin and the second leg portion is adjacent the second pin, the second seal is positioned intermediate the upper and lower pinrack supports of the pinrack assembly, and the first wing portion of the second seal is mountable to the rotor shell proximate the first sector compartment and the second wing portion of the second seal is mountable to the rotor shell proximate the second sector compartment.

8. The rotary heat exchanger of claim 7 wherein the first seal comprises oppositely disposed first and second surfaces, wherein the first and second leg portions extend substantially orthogonally from the first surface to an outboard edge.

9. The rotary heat exchanger of claim 7 wherein the second seal comprising oppositely disposed first and second surfaces, wherein the first and second wing portions extend obliquely from the first surface to an inboard edge.

10. The rotary heat exchanger of claim 7 wherein the first seal further comprises first and second edges defining a height and the second seal further comprises first and second edges defining a height, wherein the height of the second seal is greater than the height of the first seal.

11. The rotary heat exchanger of claim 10 wherein the first edge of the first seal engages the upper pinrack rail of the pinrack assembly and the second edge of the first seal is engages the lower pinrack rail of the pinrack assembly.

12. The rotary heat exchanger of claim 10 wherein the first edge of the second seal engages the upper pinrack support of the pinrack assembly and the second edge of the second seal engages the lower pinrack support of the pinrack assembly.

13. The rotary heat exchanger of claim 8 wherein the outboard edge of the first leg portion engages the first pin and the outboard edge of the second leg portion engages the second pin.

14. The rotary heat exchanger of claim 9 wherein the inboard edges of the first and second wing portions are mounted to the rotor shell.

15. A pinrack seal assembly for a rotary heat exchanger having a rotor shell, a plurality of diaphragms defining a plurality of sector compartments wherein each diaphragm separates a first sector compartment from an adjacent second sector compartment, and a pinrack assembly including upper and lower pinrack supports, upper and lower pinrack rails mounted intermediate the upper and lower pinrack supports, and a plurality of pins mounted intermediate the upper and lower pinrack rails, wherein the upper and lower pinrack supports include a plurality of support segments, the support segments being substantially continuous from the first diaphragm to the second diaphragm, and wherein a first pin and a second pin are the two pins that are closest to the diaphragm separating the first sector compartment from the second sector compartment, the pinrack seal assembly comprising:

a first seal comprising a base portion having oppositely disposed first and second surfaces and first and second leg portions extending substantially orthogonally from the first surface of the base portion; and a second seal comprising a base portion having oppositely disposed first and second surfaces, first and second wing portions extending obliquely from the first surface of the base portion, and first and second edges, wherein the second surface of the base portion of the second seal is mounted to the second surface of the base portion of the first seal;

wherein the first seal is positionable intermediate the upper and lower pinrack rails of the pinrack assembly such that the first leg portion is adjacent the first pin and the second leg portion is adjacent the second pin, and wherein the second seal is positionable intermediate the upper and lower pinrack supports of the pinrack assembly, the first edge of the second seal being engageable with the upper pinrack support of the pinrack assembly and the second edge of the second seal being engageable with the lower pinrack support of the pinrack assembly, and the first wing portion of the second seal is mountable to the rotor shell proximate the first sector compartment and the second wing portion of the second seal is mountable to the rotor shell proximate the second sector compartment.

16. A rotary heat exchanger comprising:

a rotor shell;

a plurality of diaphragms disposed interiorly of the rotor shell, the diaphragms defining a plurality of diaphragm pairs and plurality of sector compartments, wherein one of the diaphragms separates a first sector compartment from an adjacent second sector compartment;

a pinrack assembly disposed exteriorly of the rotor shell comprising upper and lower pinrack supports mounted to the rotor shell, upper and lower pinrack rails mounted intermediate the upper and lower pinrack supports, and a plurality of pins mounted intermediate the upper and lower pinrack rails, wherein the upper and lower pinrack supports each comprise a plurality of support segments wherein the support segments are substantially continuous from one diaphragm of a diaphragm pair to the other diaphragm of the diaphragm pair and wherein a first pin and a second pin are the two pins that are closest to the diaphragm separating the first sector compartment from the second sector compartment; and a plurality of pinrack seal assemblies wherein each pinrack seal assembly comprises a U-shaped first seal comprising a base portion and first and second leg portions and a trough-shaped second seal comprising a base portion mounted to the base portion of the first seal, first and second wing portions and first and second edges, wherein the first seal is positioned intermediate the upper and lower pinrack rail of the pinrack assembly wherein the first leg portion is adjacent the first pin and the second leg portion is adjacent the second pin, the second seal is positioned intermediate the upper and lower pinrack supports of the pinrack assembly wherein the first edge of the second seal engages the upper pinrack support of the pinrack assembly and the second edge of the second seal engages the lower pinrack support of the pinrack assembly, and the first wing portion of the second seal is mountable to the rotor shell proximate the first sector compartment and the second wing portion of the second seal is mountable to the rotor shell proximate the second sector compartment.

* * * * *